US006785976B1

(12) United States Patent
Morehouse

(10) Patent No.: US 6,785,976 B1
(45) Date of Patent: Sep. 7, 2004

(54) RIGHT ANGLE COMBINATION SQUARE

(76) Inventor: Michael Morehouse, P.O. Box 285, Holmesville, OH (US) 44633

( * ) Notice: Subject to any disclaimer, the term of this patent is extended or adjusted under 35 U.S.C. 154(b) by 0 days.

(21) Appl. No.: 10/442,620

(22) Filed: May 22, 2003

(51) Int. Cl.[7] ..... B43L 13/00; B43L 7/10

(52) U.S. Cl. ..... 33/480; 33/495; 33/465; 33/418

(58) Field of Search ..... 33/480, 464, 465, 33/495, 418

(56) References Cited

U.S. PATENT DOCUMENTS

| | | | | | |
|---|---|---|---|---|---|
| 500,727 | A | * | 7/1893 | Walentowitz | 33/418 |
| 1,295,399 | A | | 2/1919 | Wells | |
| 1,488,482 | A | | 4/1924 | Eckman | |
| 1,523,265 | A | | 1/1925 | Hobbs | |
| 1,532,353 | A | * | 4/1925 | Ninde | 33/341 |
| 1,549,596 | A | | 8/1925 | Mickle | |
| 1,945,987 | A | * | 2/1934 | Ware | 33/418 |
| 3,510,950 | A | * | 5/1970 | Andrews | 33/418 |
| 4,028,814 | A | | 6/1977 | Andrews | 33/94 |
| 4,497,119 | A | * | 2/1985 | Dearman | 33/464 |
| 4,736,524 | A | | 4/1988 | King | 33/451 |
| 5,020,233 | A | | 6/1991 | Syken | 33/465 |
| 5,271,159 | A | * | 12/1993 | Chen et al. | 33/403 |
| 5,359,782 | A | * | 11/1994 | Langmaid | 33/415 |
| 5,446,969 | A | | 9/1995 | Terenzoni | 33/419 |
| 5,832,618 | A | | 11/1998 | Scarborough | 33/451 |
| 5,915,807 | A | | 6/1999 | Ilagan | 33/471 |

* cited by examiner

*Primary Examiner*—Diego Gutierrez
*Assistant Examiner*—Yaritza Guadalupe
(74) *Attorney, Agent, or Firm*—Renner, Kenner, Greive, Bobak, Taylor & Weber

(57) ABSTRACT

A combination square comprising a blade; and a head defining a slot in which said blade is at least partially received, said blade extending generally perpendicular to said head; wherein said head is divided into a first portion and a second portion, said first portion defining said slot, wherein said first and second portions are pivotally joined to each other by a pivot assembly, said pivot assembly defining an axis that extends parallel to said blade, whereby said second portion may be rotated about said axis.

15 Claims, 3 Drawing Sheets

RIGHT ANGLE COMBINATION SQUARE

RELATED PATENT APPLICATIONS

None.

FIELD OF THE INVENTION

In general, the present invention relates to a measuring apparatus. More particularly, the present invention relates to a combination square typically used in carpentry applications or other applications where layout or checking functions are performed. Most particularly, the present invention relates to a combination square having a pivoting head portion that allows the square to be used with radiused or otherwise irregular surfaces.

BACKGROUND OF THE INVENTION

In carpentry, one of the most common and indispensable measuring tools is the square. Squares come in a number of varieties including L-shaped framing squares, triangular speed squares, and combination squares, among others. Each square, while performing the same basic function, generally has some advantage over others for particular applications. For example, a framing square, which generally consists of a long blade and a shorter, narrower tongue is useful for marking wide boards, checking the squareness of sheet stock, and laying out framing elements, such as rafter or stringers. A speed square is a right triangle and has a flange along its base which can be butt against the work piece edge allowing the user to rapidly draw or cut square or 45 degree lines. A combination square which includes a shorter handle-like leg, often referred to as a head, that slidably receives a blade is useful in laying out lines and transferring distances. The head has fences at 90 and 45 degrees that allows the user to quickly transfer a distance accurately and hold it while a line is drawn with a scribe or pencil. Often, the head is provided with a leveling bubble.

One difficulty that exists with using such squares occurs, when the edge of the work piece is not at a right angle to the surface on which markings or cuts are being made. For example, such irregular edges may be beveled or rounded such that very little of the fence can be placed against the surface. Often, due to the limited amount of contact between the fence and the work piece, the square tends to rock or slip because there is no corner to trap between the head and the blade.

SUMMARY OF THE INVENTION

In view of the foregoing, it is an object of the present invention to provide an improved combination square.

It is another object of the present invention to provide a combination square having a jointed head that allows rotation about an axis parallel to the blade permitting use of the combination square with irregular comers.

In view of at least one of the foregoing objects, the present invention generally provides a combination square comprising: a blade; and a head defining a slot in which said blade is at least partially received, said blade extending generally perpendicular to said head; wherein said head is divided into a first portion and a second portion, said first portion defining said slot, wherein said first and second portions are pivotally joined to each other by a pivot assembly, said pivot assembly defining an axis that extends parallel to said blade, whereby said second portion may be rotated about said axis.

The present invention further provides a combination square comprising: a blade; a head on which said blade is received, said head having a first fence extending generally perpendicular to said blade and a second fence extending at an angle relative to said blade, said head being divided into a first section and a second section pivotally jointed to each other about an axis, wherein said head includes a first pivot assembly at said first fence and a second pivot assembly adjacent said second fence and interiorly thereof; said first pivot assembly including a first tab extending downwardly from a first section of said head and a second tab extending upwardly from a second section of said head such that said tabs overlap each other and define a bore that extends through both of said tabs along said axis, and a pin received within said bore; and wherein said second pivot assembly includes a tab extending downwardly from said first portion and a sleeve formed on said second portion coaxially located with said tab, said sleeve and said tab defining a bore along said axis, said sleeve having a recess of a large dimension than said bore at one end defining a shoulder, a fastener having an enlarged end at one end and a threaded end at the opposite end insertably received within said bore, wherein said enlarged head portion of said fastener resides within said recess and is engagable with said shoulder to limit axial movement of said fastener, and a thumb screw threadably mounted on said threaded end of said fastener and rotatable thereon to selectively lock said second portion of said head in a selected position relative to said axis.

BRIEF DESCRIPTION OF THE PREFERRED EMBODIMENTS

Figure 3:
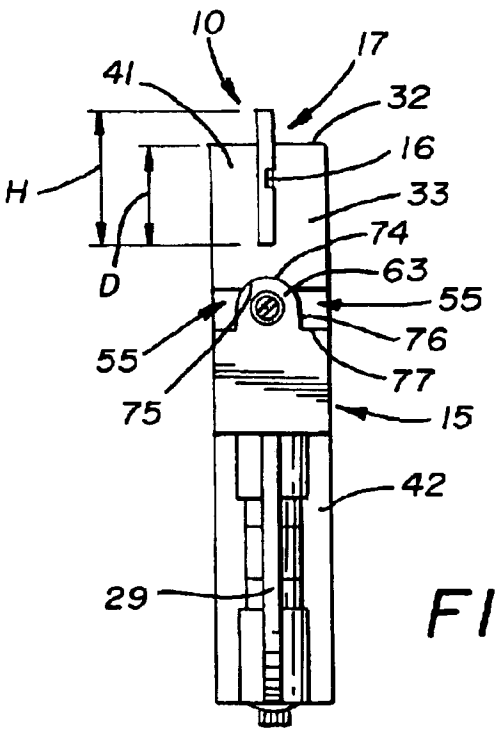
FIG. 3 is a left side elevational view thereof.

A combination square according to the concepts of the present invention is generally referred to by the numeral 10 in the accompanying drawings. Combination square 10 includes a blade 11 which may include demarcations 12 for providing reference points when the blade 11 is used on a workpiece W. As is common, the demarcations 12 may form a rule. The combination square 10 further includes a head, generally indicated by the numeral 15, that is provided with a slot 16 adapted to slidably receive the blade 11. As best shown in FIG. 3, the slot 16 may have a depth D less than the height H of the blade 11 such that a portion, generally indicated at 17 of the blade 11 protrudes above the head 15.

Figures 1, 6:
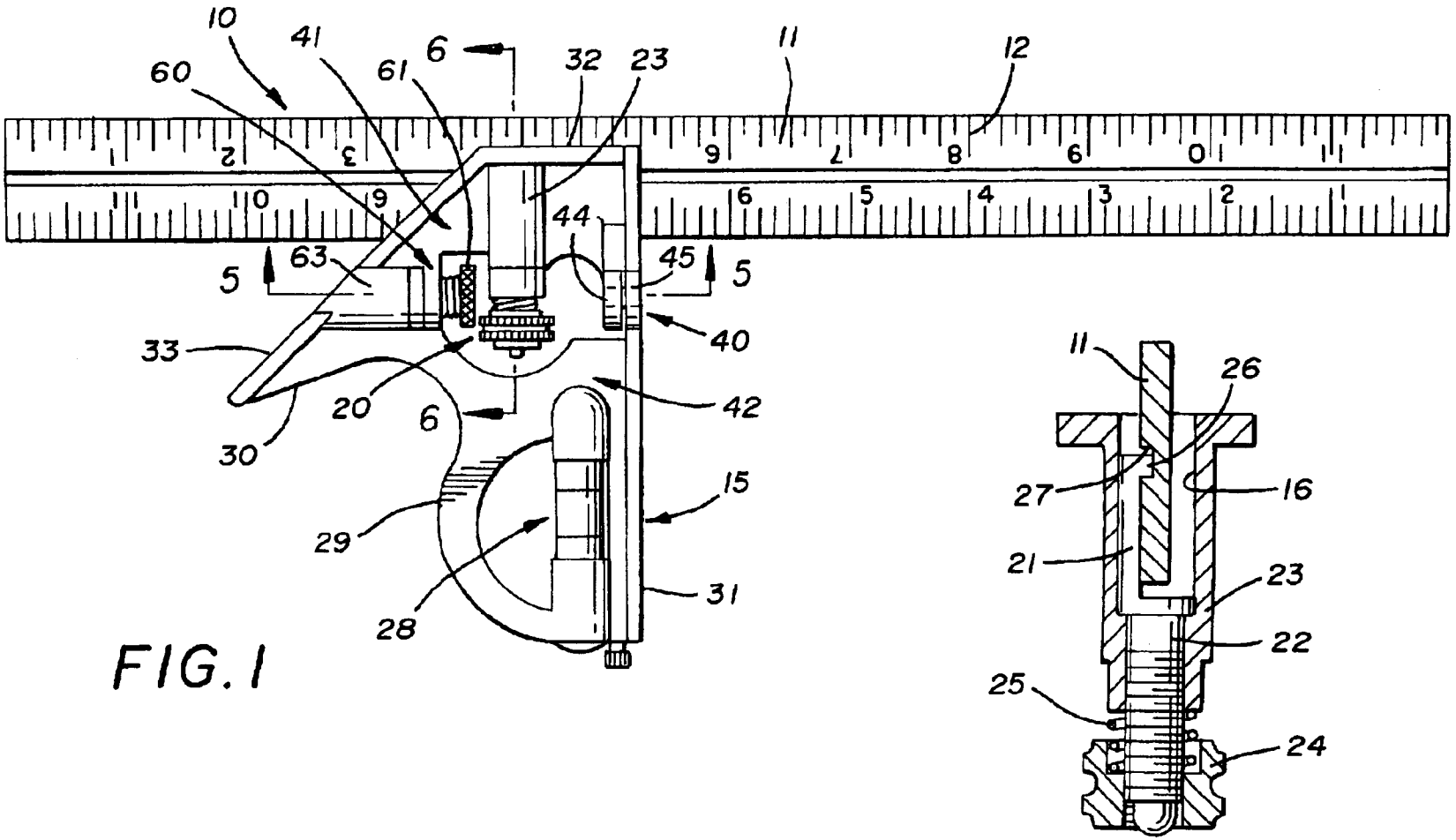
FIG. 1 is a front elevational view of a combination square according to the concepts of the present invention.
FIG. 6 is a sectional view as might be seen along line 6—6 in FIG. 1.
Figure 2:
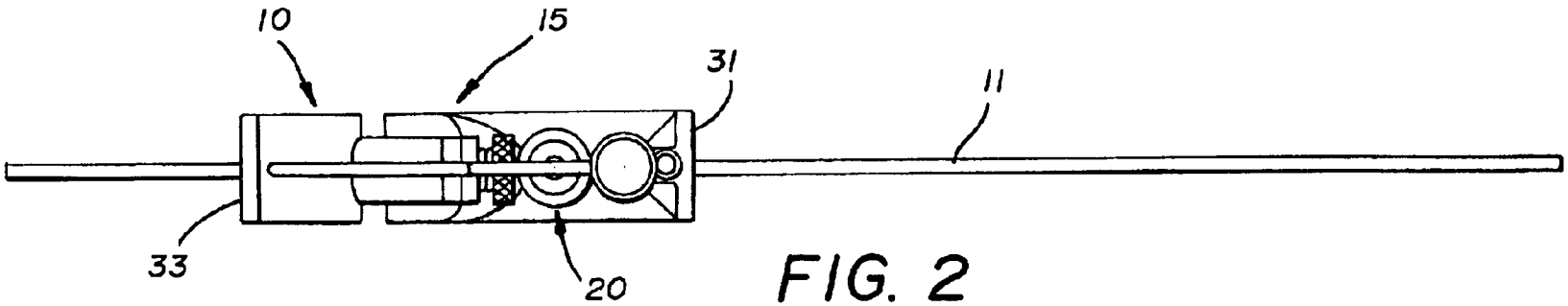
FIG. 2 is a top plan view thereof.

The head 15 may be locked in a selected position along the length of the blade 11 by means of a first thumb locking screw assembly, generally indicated by the numeral 20, and depicted in more detail in FIG. 6. As can be seen in FIG. 6, thumb locking screw assembly includes a generally L-shaped head 21 having a threaded lower portion 22 that protrudes from a sleeve 23 formed in the head 15. An internally threaded thumb screw 24 attaches to the exposed threaded end 22 and may include a spring 25 to facilitate operation of the thumb locking screw 20. An inwardly extending lateral projection 26 is received within a slot 27 formed in the blade 11 and serves to clamp the blade by tightening of the thumb screw 24 against the sleeve 23. Thus, to adjust the position of the head 15 along the length of the blade 11, the thumb screw 24 is loosened to release the clamping force on the blade 11 and the blade then may be slid lengthwise with the projection 26 riding in the groove 27. Once the blade 11 is placed in the desired position, the thumb screw 24 is tightened to lock the blade 11 in place.

To facilitate leveling or to check the level of blade 11, or head 15, a leveling bubble assembly, generally indicated by the numeral 28, may be provided on the head assembly 15. Leveling bubble assemblies are commonly used in the art and, thus, only general reference is made to this assembly. Since the head assembly 15 is often used as a handle, a contoured gripping surface 29 may be provided at a lower rearwardly facing portion of the head assembly 15. Gripping surface 29 may provide a notch 30 that extends inwardly toward the thumb screw assembly 20 allowing the user to grasp the blade with their thumb in close proximity to the thumb screw assembly 20 for ease of operation.

Head assembly 15 is provided with one or more fences that are used to engage the workpiece W and position the blade 11 in desired relation thereto. For example, in the embodiment shown, a first fence 31 lies perpendicular to the blade 11 such that a perpendicular arrangement of the blade 11 to an edge E of the workpiece W may be achieved. A second fence 32 extends at an angle relative to the blade 11 to place the blade 11 in an angular relationship to the edge E of the workpiece W. In most instances, as depicted in the example shown, second fence 32 extends at a 45 angle relative to the blade 11. It will be appreciated, however, that other angles of inclination could be used. At the top of the head assembly 15, a third fence 33 extends parallel to the blade 11 between the first and second fences 31, 32 to facilitate parallel orientation of the blade 11 relative to an edge E of the workpiece W.

Figure 4:
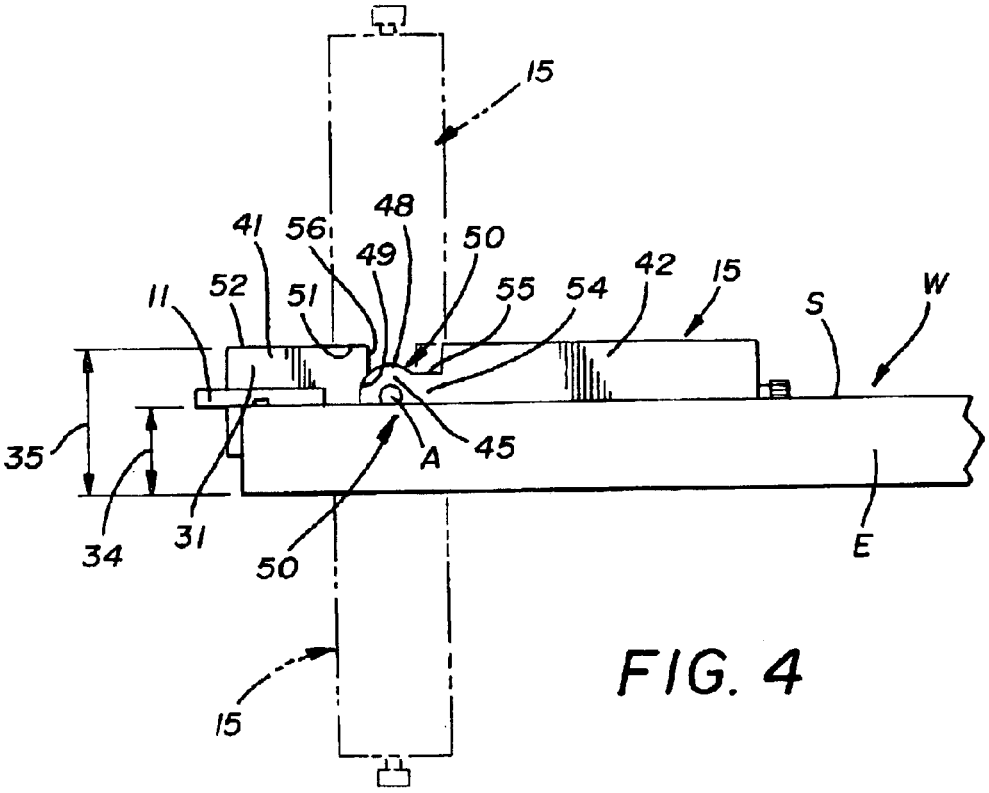
FIG. 4 is a right side elevational view thereof with rotated positions of the head being shown in phantom line.

As mentioned in the background, combination squares are often used to transfer distances from one workpiece W to another and lay out measurements on a workpiece W. In that regard, the square is butted against the edge of the workpiece W at a fence, for example, first fence 31, as when measuring a distance perpendicular to the edge E of the workpiece W. It is preferable to lay the blade 11 flat along the surface of the workpiece W that is being measured to make it easier to read the demarcations 12 and mark the workpiece W accordingly. Thus, the head 15 is oriented such that the length of the fence 31 extends parallel to the edge E of the workpiece W. In this way, the contact between the workpiece edge E and fence 31 is limited to a portion 34 of the fence width 35 extending below the blade 11, as best shown in FIG. 4. While only the first fence 31 is discussed, the same practices apply to fences 32 and 33 and, thus, the use of the first fence 31 as an example will apply to fences 32 and 33.

Figure 7:
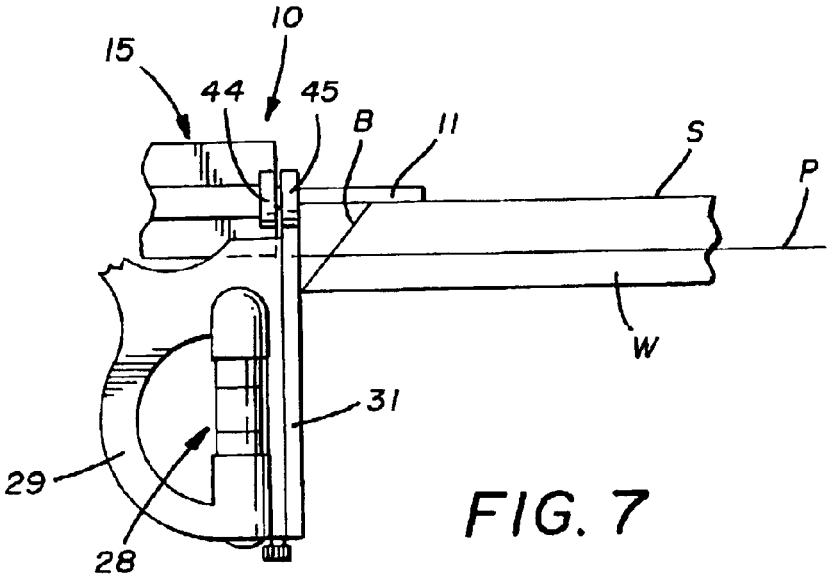
FIG. 7 is a fragmented front elevational view depicting use of a square according to the concepts of the present invention with a workpiece having an irregular edge.

As best shown in FIG. 7, when using the combination square with a beveled edge B, the limited contact area provided by the fence 31, represented by a plane P extending along the lower surface of the fence 31 would cause the combination square 10 to contact the workpiece W at the beveled edge B. It will be appreciated that this contact is limited essentially to a point where the fence 31 and beveled edge B meet making it difficult to maintain the position of the combination square 10. Consequently, to provide improved contact, head 15 is made pivotable about an axis A to provide improved contact with the workpiece W. In the example shown in FIG. 4, the head 15 pivots about axis A a full 180 degrees. The fully rotated positions are shown in phantom lines in FIG. 4.

Figure 5:
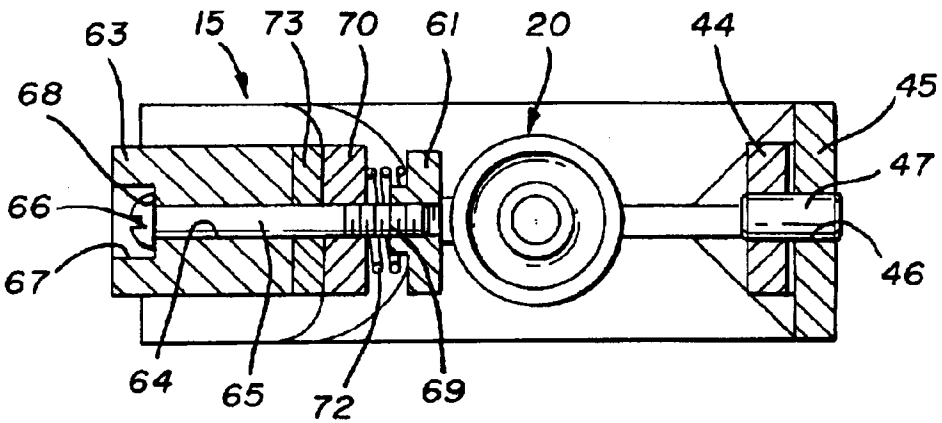
FIG. 5 is a sectional view as might be seen along line 5—5 in FIG. 1.

In the example shown, the head 15 includes first pivot assembly, generally indicated by the numeral 40, that divides the head 15 into a first portion, generally indicated by the numeral 41, and a second portion, generally indicated by the numeral 42, that are pivotally joined along axis A. For example, first pivot assembly may include overlapping tabs 44, 45 that extend respectively from the first portion 41 and second portion 42 near the first fence 31 and define a bore 46 through which a pin 47 is received (FIG. 5). As can be seen in FIG. 5, the tab 44 extending from first head portion 41 is located axially inward from the first fence 31 and the second tab 45 is formed completely within the plane of the first fence 31, such that, it does not interfere with proper placement of the first fence 31 against a workpiece W in the ordinary fashion shown in FIG. 4. As best shown in FIG. 4, to accommodate pivotal movement of the second portion 42, the peripheral surface 48 of tab 45 may be rounded and received within a rounded recess 49 formed in the portion of first fence 31 on first head portion 41. Clearances 50 may be provided in first fence 31 on either side of the tab 45 to permit free rotation of the second portion 42 relative to the first portion 41. To limit the range of rotation, the top edge 51 of second portion 42 butts against a side edge 52 of first portion 41 to stop rotation of the second portion 42. Further, tab 45 may be provided with a neck portion 54 that includes a side wall 55 that butts against the base 56 of the portion of first fence 31 on first portion 41 to limit movement of the pivotable second portion 42. In the example shown, the side edge 52 and base 56, and top edge 51 and side wall 55 are formed perpendicular to each other such that the surfaces contact each other squarely limiting the motion of the second portion 42 to 180 degrees of rotation. In the example shown, the edges and sidewalls are symmetrical relative to a centerline C on head 15, but to achieve different ranges of motion on either side of the ordinary position (FIG. 4), the edges may be asymmetrical. It will further be appreciated that these edges may be modified to increase or decrease the amount of permitted rotation.

At second fence 32, clearance is provided at 57 to permit rotation of the second portion 42. While only a single point of rotation is necessary to pivot the second portion 42, the head 15 may be provided with a second pivoting assembly, generally indicated by the numeral 60, at the rear of the head 15 near the second fence 33. Like the first pivoting assembly 40, the second pivoting assembly 60 may simply include a pair of tabs that define a bore through which a pin is received.

Optionally, as shown in the depicted embodiment, a thumb screw assembly 61 may be provided to selectively lock the rotational position of pivotable second portion 42 relative to the first portion 41. As best shown in FIG. 5, to accommodate such an assembly, second portion 42 is provided with a sleeve 63 that defines a bore 64 through which a threaded fastener 65 is received. The fastener 65 is provided with an enlarged head portion 66 that resides within the a recess 67 having a greater diameter than the bore 64 and providing a shoulder 68 against which the head 66 of fastener 65 may bear. By providing a recess 67 of a depth greater than the head portion 66 of fastener 65, the fastener 65 does not protrude or interfere with the use of second fence 32. At least a portion of the threaded end 69 of fastener 65 extends externally of the sleeve 63 through tab 70, which extends downwardly from the first portion 41 of head assembly 15, for mounting of the thumb screw 61. As in the first thumb screw assembly 20, second thumb screw assembly 61 may be tightened against the tab 70 to provide a clamping force that holds the second portion 42 of head assembly 15 in a desired position. To facilitate rotation, a washer 73 may be provided between tab 70 and sleeve 63. As in the previously described thumb screw assembly 20, a spring 72 may be provided to facilitate its use and maintain a tension on the fastener 65 that keeps the head portion 66 within recess 67.

As best shown in FIG. 3, to accommodate a curved outer surface 73 of sleeve 63, an arcuate recess 75 may be formed in the fence 33 at first section 41. Similar to the first pivoting assembly 40, the side wall 76 of sleeve 63 and edge 77 of second fence 32 at second portion 42 may be arranged in a perpendicular relationship to each other to stop rotation of the pivotable second portion 42 at the 0 and 180 degree positions. As described above, these surfaces may be modified to effect a different range of motion.

As an alternative to thumb locking screw assembly 61, other locking assemblies may be used to fix the relative position of the second portion 42 with respect to first portion 41. One example of which is a detent assembly, such as a spring-loaded pawl, that locks the second portion 42 in predetermined positions relative to the first portion 41. It will be appreciated that the detent assembly does not have to lock the second portion 42 relative to the first portion 41 but may also be useful in simply indicating the position of the second portion 42 relative to the first portion 41 by emitting an audible click.

In light of the foregoing, it will be appreciated that the above-described invention satisfies one or more of the objects of the present invention. It will further be appreciated that various modifications and substitutions may be made to the described invention without escaping the spirit hereof or the scope of the appended claims. Therefore, for an appreciation of the scope of the invention, reference should be made to the following claims.

What is claimed is:

1. A combination square comprising:

a blade; and a head defining a slot in which said blade is at least partially received, said blade extending generally perpendicular to said head;

wherein said head is divided into a first portion and a second portion, said first portion defining said slot, wherein said first and second portions are pivotally joined to each other by a pivot assembly, said pivot assembly defining an axis that extends parallel to said blade, whereby said second portion may be rotated about said axis.

2. The combination square of claim 1, wherein said pivot assembly includes a first tab extending downwardly from said first portion and a second tab extending upwardly from said second portion, said tabs defining a bore extending along said axis, and a pin received in said bore.

3. The combination square of claim 2, wherein said head includes a first fence extending perpendicular relative to said blade, wherein said first tab is located interiorly of said first fence and said second tab forms a part of said first fence, wherein said first fence defines a clearance on at least one side of said tab to permit rotation thereof about said pin.

4. The combination square of claim 3, wherein said second tab has a arcuate peripheral surface and a portion of said first fence located on said first portion of said head defines an arcuate recess in which said arcuate peripheral surface is at least partially received and is free to rotate therein.

5. The combination square of claim 4, wherein said tab includes a neck extending between said arcuate surface and a portion of said fence on said second portion of said head, wherein said neck is engagable with a base edge of said portion of said first fence located on said first portion of said head to limit the rotation of said second portion relative to said first portion.

6. The combination square of claim 5, wherein said portion of said first fence located on said second portion of said head includes a top edge extending laterally outward from said neck of said tab, said top edge being engagable with a side edge of said portion of said first fence located on said first portion of said head to further limit rotation of said second portion.

7. The combination square of claim 1 further comprising a pivot locking assembly adapted to lock said second portion in a selected position relative to said first portion about said axis.

8. The combination square of claim 7, wherein said pivot locking assembly includes a thumb screw assembly.

9. The combination square of claim 8, wherein said pivot assembly includes a first tab extending from said first portion and a second tab extending from said second portion, said tabs defining a bore along said axis of rotation and wherein said pivot locking assembly includes a fastener passing through said bore having a threaded end on which a thumb screw is mounted, wherein said opposite end of said fastener is axially fixed such that tightening of said thumb screw on said threaded fastener locks said tabs relative to each other.

10. The combination square of claim 9, wherein said bore includes an enlarged recess defining a shoulder; and wherein said fastener has an enlarged head at the end opposite the threaded end and engagable with said should, whereby said shoulder limits axial movement of said fastener.

11. A combination square comprising:

a blade;

a head on which said blade is received, said head having a first fence extending generally perpendicular to said blade and a second fence extending at an angle relative to said blade, said head being divided into a first portion and a second portion pivotally joined to each other about an axis, wherein said head includes a first pivot assembly at said first fence and a second pivot assembly adjacent said second fence and interiorly thereof;

said first pivot assembly including a first tab extending downwardly from a first portion of said head and a second tab extending upwardly from a second portion of said head such that said tabs overlap each other and define a bore that extends through both of said tabs along said axis, and a pin received within said bore; and wherein said second pivot assembly includes a tab extending downwardly from said first portion and a sleeve formed on said second portion coaxially located with said tab, said sleeve and said tab defining a bore along said axis, said sleeve having a recess of a larger dimension than said bore at one end defining a shoulder, a fastener having an enlarged end at one end and a threaded end at the opposite end insertably received within said bore, wherein said enlarged head portion of said fastener resides within said recess and is engagable with said shoulder to limit axial movement of said fastener, and a thumb screw threadably mounted on said threaded end of said fastener and rotatable thereon to selectively lock said second portion of said head in a selected position relative to said axis.

12. The combination square of claim 11 further comprising a spring located between said thumb screw and said sleeve, whereby said spring urges said enlarged head against said shoulder.

13. The combination square of claim 11, wherein said first fence and said second fence each define a clearance to permit rotation of said second portion of said head.

14. The combination square of claim 13, wherein said second tab of said first pivot assembly forms a part of said first fence and wherein said sleeve of said second pivot assembly forms a part of said second fence.

15. The combination square of claim 14, wherein said portions of said first and second fences on said first portion of said head define an arcuate recess and wherein said second tab and said sleeve have an arcuate peripheral surface received in the respective arcuate recesses formed on said first and second fences.

* * * * *